US007048584B1

(12) United States Patent
Morello et al.

(10) Patent No.: US 7,048,584 B1
(45) Date of Patent: May 23, 2006

(54) ELECTRICAL CONNECTOR

(75) Inventors: John R. Morello, Warren, OH (US); William G. Strang, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/159,908

(22) Filed: Jun. 23, 2005

(51) Int. Cl.
*H01R 13/40* (2006.01)

(52) U.S. Cl. ..... 439/595; 439/744

(58) Field of Classification Search ..... 439/595, 439/744, 603, 871, 869, 733.1, 746
See application file for complete search history.

(56) References Cited

U.S. PATENT DOCUMENTS 3,513,438 A * 5/1970 Henschen et al. ..... 439/746
5,017,162 A * 5/1991 Krehbiel et al. ..... 439/744
5,281,175 A 1/1994 Chupak et al.
5,722,925 A 3/1998 Kameyama et al.
5,980,318 A 11/1999 Morello et al.
6,186,837 B1 2/2001 Abe
6,280,261 B1 * 8/2001 Sakurai ..... 439/746
6,767,259 B1 7/2004 Kojima et al.

* cited by examiner

*Primary Examiner*—Tho D. Ta
*Assistant Examiner*—Felix O. Figueroa
(74) *Attorney, Agent, or Firm*—David P. Wood

(57) ABSTRACT

An electrical connector includes a connector body and an electrical terminal. The connector body has a terminal receiving cavity that includes a lock nib that extends from a floor into the cavity. The terminal has a lock bar that engages the lock nib to retain the terminal in the terminal receiving cavity. The lock nib and lock bar are shaped to increase terminal retention.

5 Claims, 4 Drawing Sheets

ELECTRICAL CONNECTOR

TECHNICAL FIELD

This invention relates to an electrical connector, and more particularly to an electrical connector having a terminal retained in a terminal receiving cavity of a connector body.

BACKGROUND OF THE INVENTION

U.S. Pat. No. 5,980,318 granted to Morello, et al. Nov. 9, 1999, which is assigned to the assignee of the present invention, discloses an electrical connector having a terminal receiving cavity defined in part by a rigid floor wall that has a rigid lock nib that extends upwardly from the rigid floor wall into the terminal receiving cavity. A flexible beam opposes the rigid floor wall, and a ceiling wall includes a terminal hold down bump extending toward the rigid floor wall at a location generally opposite the rigid lock nib. The connector body receives a terminal in each terminal receiving cavity. Each terminal has a recess defined in part by a rigid lock bar. That is attached to side walls of the terminal. The rigid lock nib is disposed in the terminal recess when the terminal is fully seated in the terminal cavity with the rigid lock bar engaging the rigid lock nib to prevent the seated terminal from being pulled out of the terminal cavity.

SUMMARY OF THE INVENTION

The object of this invention is to provide an improved electrical connector of the type in which a terminal has a rigid lock bar that engages a rigid lock nib in a terminal cavity of a connector body to prevent the terminal from being pulled out of the connector body.

This invention provides an electrical connector having an improved terminal retention arrangement preferably an arrangement where the terminal pull-out resistence increases substantially as the terminal pull-out force is increased.

In one aspect, a feature of the invention is that the rigid lock bar of the terminal has a wedge portion that digs into the rigid lock nib of the connector body to increase terminal pull-out resistence substantially.

In another aspect, a feature of the invention is that the rigid lock bar of the terminal engages an angled surface of the rigid lock nib so that the lock bar of the terminal is pulled toward the wall of the terminal receiving cavity behind the rigid lock nib responsive to a terminal pull-out force applied to the terminal, thus assuring that the lock bar does not override the rigid lock nib.

In still another aspect, a feature of the invention is that the terminal has side walls with angled faces that engage an angled surface of the rigid lock nib to provide improved terminal retention.

While each of the above features results in improved terminal retention, it is preferable to include at least two and more preferably all three features for improving terminal retention.

These and other features and advantages of the present invention will be apparent from the following brief description of the drawings, detailed description, claims, and appended drawings.

BRIEF DESCRIPTION OF THE DRAWINGS

The above-mentioned features of the present invention can be more clearly understood from the following detailed description considered in conjunction with the following drawings, in which like numerals represent like elements and in which.

DETAILED DESCRIPTION OF THE PREFERRED EMBODIMENT

Figure 1:
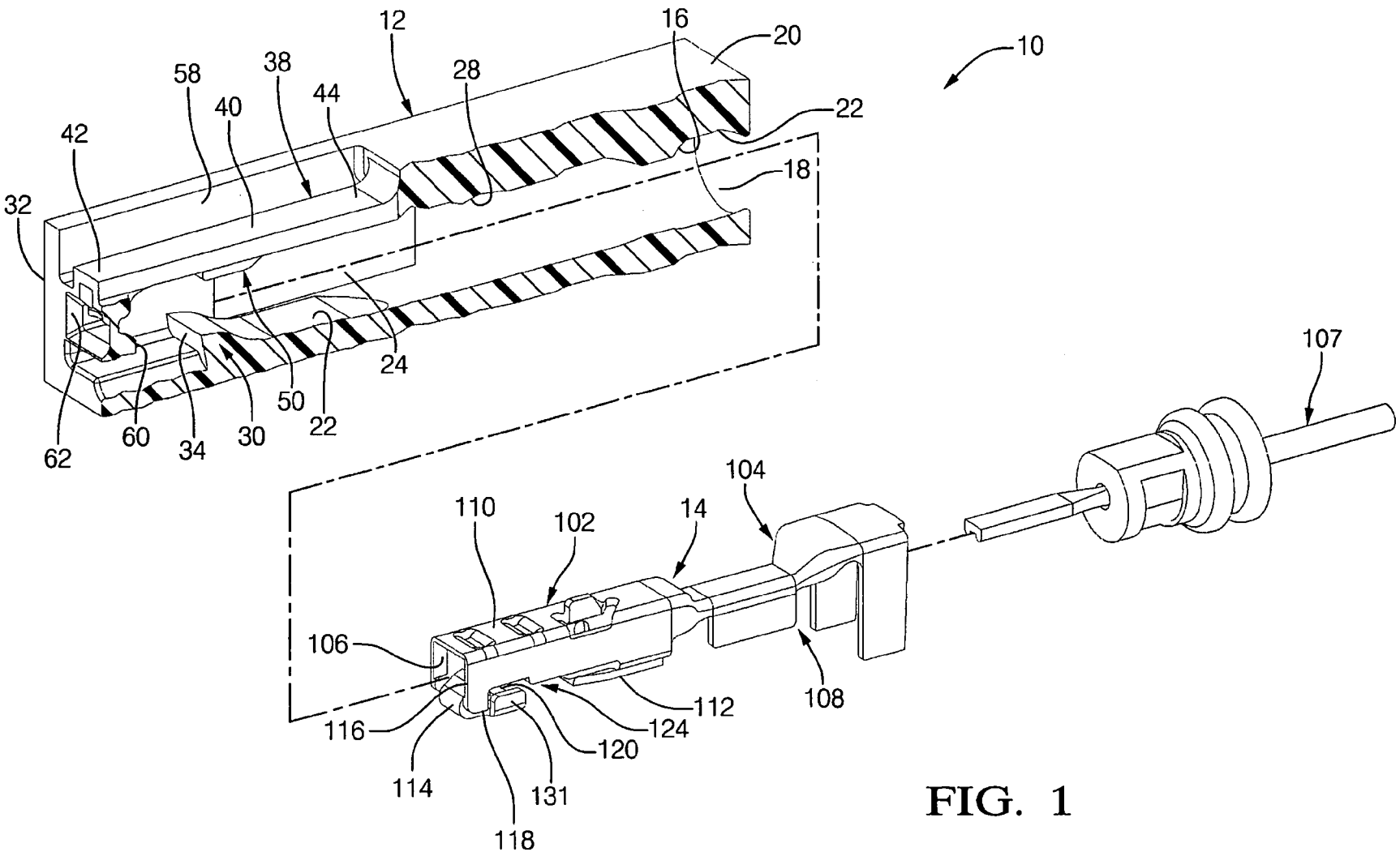
FIG. 1 is an exploded partially sectioned perspective view of an electrical connector in accordance with the present invention.

FIGS. 1–6 illustrate an exemplary embodiment of an electrical connector 10 according to the present invention. Electrical connector 10 includes a connector body 12 and a female terminal 14 that is inserted into a terminal receiving cavity 16 through an opening 18 in a rear cable end 20 of the connector body 12.

Terminal receiving cavity 16 is defined in part by a rigid floor wall 22. Opposed upright side walls 24, 26 extend transversely from floor wall 24 and a ceiling wall 28 extends between the side walls 24, 26. Floor wall 22 is preferably attached to side walls 24, 26 to prevent movement or flexing of floor wall 22.

Figure 5:
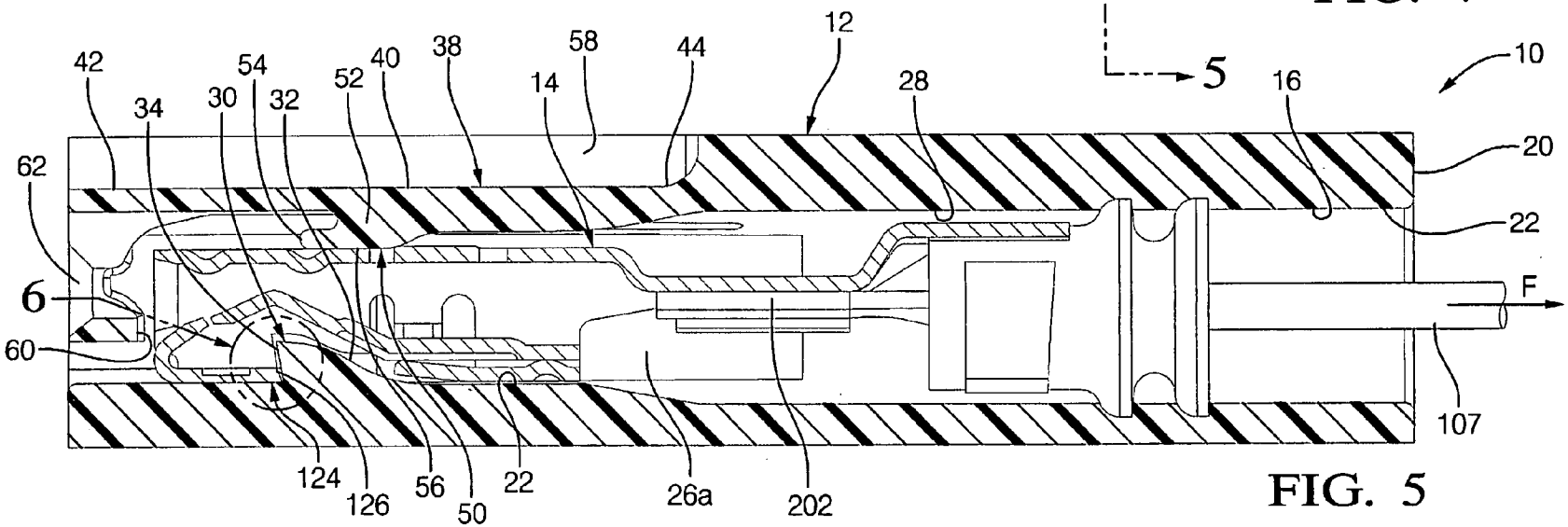
FIG. 5 is a longitudinal section view of the electrical connector taken substantially along the line 5—5 of FIG. 4 looking in the direction of the arrows.
Figure 6C:
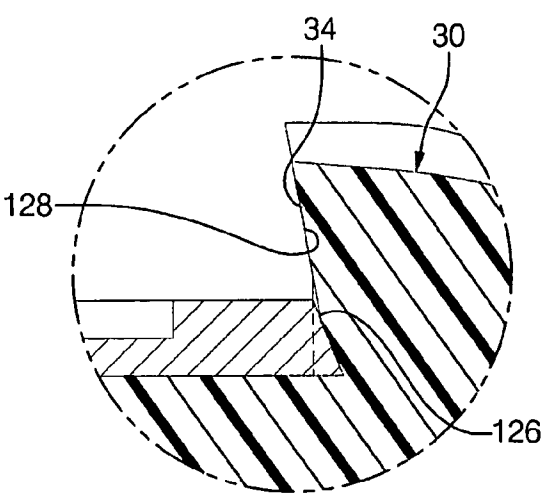
FIGS. 6A, 6B and 6C are enlargements of portion 6 of FIG. 5 under various conditions.
Figure 6B:
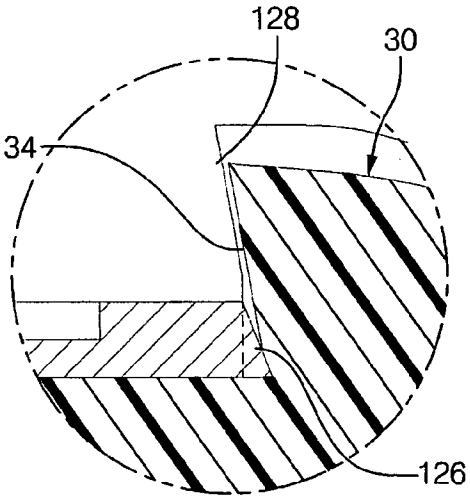
Figure 6A:
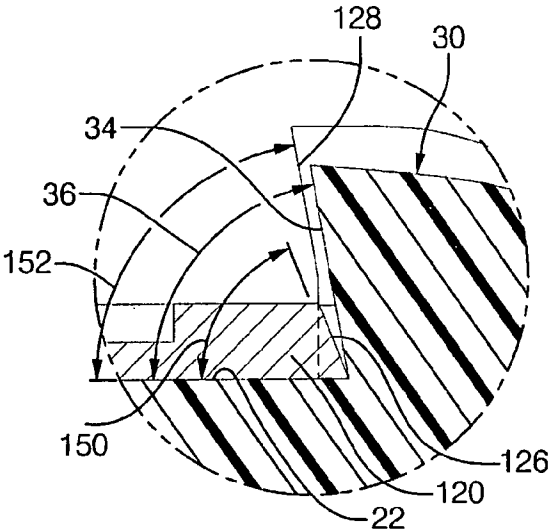

A rigid lock nib 30 extends inwardly from floor wall 22 into terminal receiving cavity 16. Lock nib 30 includes an angled surface 34 that slopes upwardly and inwardly from floor wall 22 in a direction away from the rear cable end 20 of connector body 12. Angled surface 34 defines an acute angle 36 with respect to floor wall 22 as best shown in FIG. 6A. As best shown in FIGS. 1 and 5, lock nib 30 extends between side walls 24, 26 and is attached to each side wall 24, 26.

A flexible beam 38 extends from ceiling wall 28 into terminal receiving cavity 16 opposite floor wall 22 as best shown in FIG. 5. Flexible beam 38 includes a bridge portion 40 extending between first and second end portions 42, 44. First end portion 42 is attached to the connector body 12 at a contact end 32. Second end portion 44 is attached to the cable end 20 of connector body 12 via ceiling wall 28. Flexible beam 38 is preferably attached to side walls 24, 26 only at the end portions 42, 44. Flexible beam 38 includes a protuberance or terminal hold down bump 50 that protrudes from bridge portion 40 inwardly toward floor wall 22 at a location generally opposite rigid lock nib 30. Terminal hold down bump 50 provides a deflection point for flexible beam 38.

Figure 2:
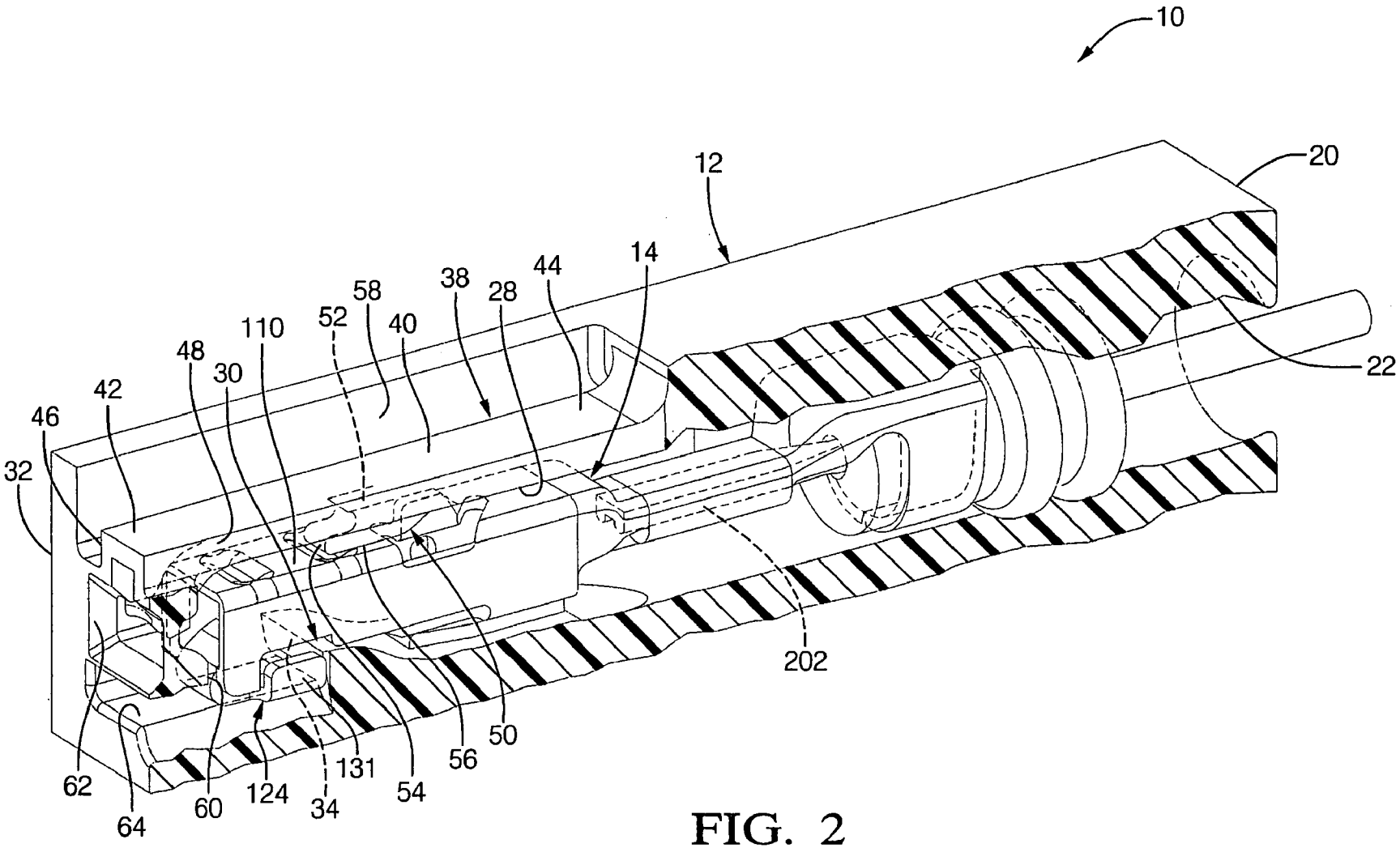
FIG. 2 is a sectioned perspective view of the electrical connector shown in FIG. 1.
Figure 4:
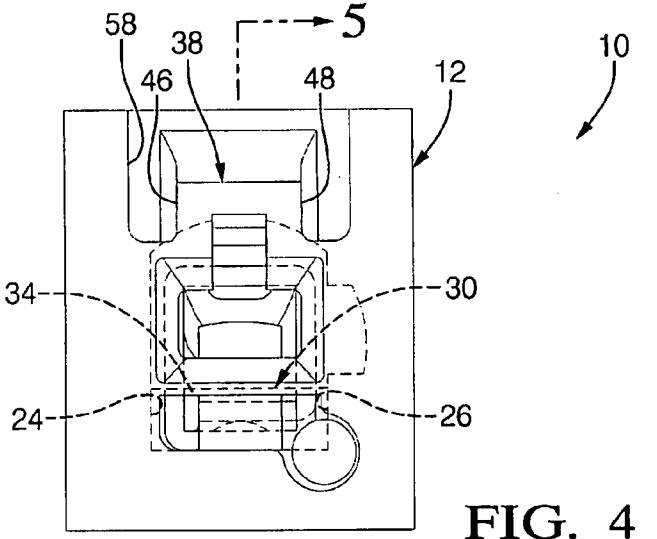
FIG. 4 is an end view of the electrical connector shown in FIG. 1.

As shown in FIGS. 2 and 5, terminal hold down bump 50 has a base 52 that extends from bridge portion 40 and a substantially rigid cantilevered terminal stabilizing member 54 that projects from terminal hold down bump base 52 forward toward the contact end 32 of connector body 12. In the longitudinal sectional view, terminal stabilizing member 54 resembles a toe extending generally in parallel with respect to bridge portion 40 of flexible beam 38. Terminal hold down bump 50 and terminal stabilizing member 54 together define a terminal contact surface 56. Connector body 12 has a second cavity 58 above flexible beam 38 to facilitate movement or deflection of beam 38.

Electrical terminal 14 is a one piece metal member of relatively thin gauge metal stock and comprises, in general, a forward, generally box shaped contact portion 102 and a rearward cable attachment portion 104. Contact portion 102 has an opening 106 for receiving a contact pin or blade of a male terminal (not shown). Cable attachment portion 104 is constructed for attachment to an electric cable 107 by a metal crimp section 108 comprising conventional core and cable crimp wings.

Figure 3:
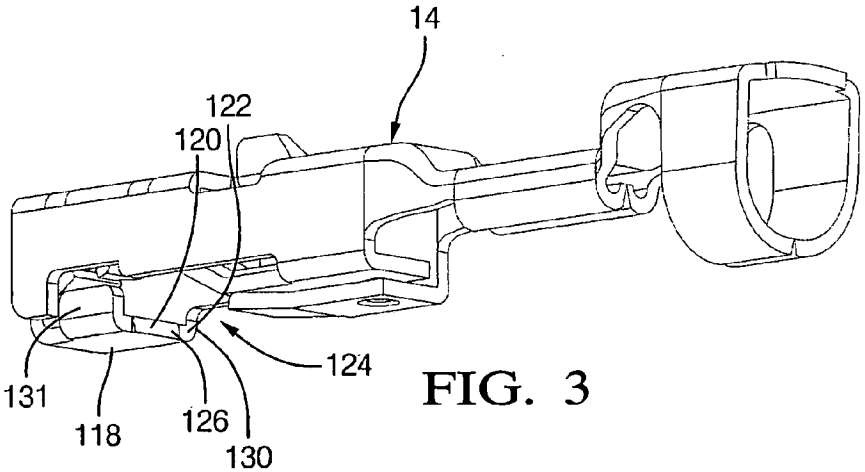
FIG. 3 is a perspective view of a female terminal that is part of the electrical connector shown in FIG. 1.

Contact portion 102 has a top surface 110, and a bottom surface 112. Contact portion 102 includes a lock member 114 extending rearward from a forward end 116 of contact portion 102. Lock member 114 has an outer portion 118 that includes a rigid lock bar 120 having an end face 122 as best shown in FIG. 3. Lock bar 120 is behind angled surface 34 of lock nib 30 when terminal 14 is seated in connector body 12 as shown in FIG. 5 and as further explained below in connection with FIGS. 6A, 6B and 6C.

Contact portion 102 has a recess or aperture 124 for receiving lock nib 30. Lock bar 120 includes a central wedge portion 126 between flat portions 127 formed on end face 122 for engaging angled surface 34 of lock nib 30 when terminal 14 is seated in terminal receiving cavity 16 as further explained below.

Lock member 114 further includes laterally spaced walls 130, 131 extending upwardly from opposite sides of lock bar 120. Each side wall 130, 131 has an angled surface 128 that engages the angled surface 34 of lock nib 30 as best shown in FIG. 6C and as further explained below.

To assemble the electrical connector 10, contact portion 102 of terminal 14 is inserted through opening 18 in rear cable end 20 of connecting body 12 and into terminal receiving cavity 16. The leading end of contact portion 102 engages lock nib 30 and terminal 14 rides up a sloped back surface of lock nib 30 lifting terminal 14 away from floor wall 22. As terminal 14 rides up the sloped back surface of lock nib 30, top surface 110 engages terminal hold down bump 50 and flexible beam 38 flexes upward into second cavity 58 to accommodate the movement of terminal 14 between the lock nib 30 and terminal hold down bump 50. Terminal stabilizing member 54 follows along with flexible beam 38 as it deflects upward. The deflection of flexible beam 38 during terminal 14 insertion causes terminal stabilizing member 54 to rotate from an initial orientation into alignment with incoming terminal 14. As terminal 14 is pushed forward further into terminal receiving cavity 16, recess or aperture 124 overlies rigid lock nib 30 at which point the resilient force of flexible beam 38 applied to top surface 110 of terminal 14 urges terminal 14 down against rigid floor wall 24 returning terminal stabilizing member 54 to its initial orientation and seating terminal 14 in terminal receiving cavity 16 of connector body 12 as shown in FIGS. 2 and 5. In this seated position, terminal hold down bump 50 of flexible beam 38 contacts top surface 110 of terminal 14 biasing terminal 14 toward rigid floor wall 24, the angled surface 34 of lock nib 30 engaging rigid lock bar 120 preventing terminal 14 from backing out of terminal receiving cavity 16 through opening 18 in cable end 20. Cantilevered terminal stabilizing member 54 also engages top surface 110 of terminal 14 resisting rocking or rotational movement of terminal 14 within terminal receiving cavity 16.

A stop 60, such as the inside wall of contact end 32, is provided in connector body 12 to prevent terminal 14 from moving in a forward direction. A male terminal pin or blade (not shown) may be inserted through connector body opening 62, through terminal opening 106 and into the contact portion 102 of terminal 14. Connector body 12 has a third opening 64 below opening 62 that communicates with terminal receiving cavity 16 so that a tool (not shown) can be inserted into terminal receiving cavity 16 to lift terminal 14 up and raise lock bar 120 above lock nib 30 thereby allowing terminal 14 to be pulled out through opening 18 in cable end 20.

Referring to FIG. 5, the terminal hold down bump base 52 is preferably attached at the center of the flexible beam 38 so that the terminal hold down bump 50 provides a deflection point at an optimal location near the center of flexible beam 38 to minimize the force required to insert terminal 14 into terminal receiving cavity 16 while cantilevered terminal stabilizing member 54 projects forwardly from terminal hold down bump base 52 to resist rotational movement of terminal 14. Terminal hold down bump base 52 preferably has a terminal contact area that is less than the total terminal contact area of bump 50. This is advantageous because a smaller base generally enables a more flexible, less rigid beam thereby enabling a low terminal insertion force, while a large terminal contact area generally provides greater support for terminal 14 and greater terminal stability.

Referring now to FIGS. 2 and 5 in general and to FIGS. 6A, 6B and 6C in particular, the improved terminal retention will now be explained in detail. FIG. 6A shows an end play condition where the lock bar 120 is spaced slightly ahead of the lock nib 30 which may or may not occur in actual operation. In any event, this condition facilitates an explanation the shapes of various parts of the retention arrangement.

When a terminal pull-out force F is applied to the terminal 14 most commonly by pulling on the electric cable 107 as shown in FIG. 5, any end play is removed first. That is, the lock bar 120 is pulled against the angled surface 34 of the lock nib 30 and the terminal 32 is then pulled down toward the bottom wall 22 behind the lock nib 30 into fully seated engagement with the bottom wall 22 at the bottom of the lock nib 30 as shown in FIG. 6B. This is one aspect of the improved terminal retention arrangement of the invention. This feature assures that the lock bar 120 does not ride over lock nib 30 responsive to a terminal pull-out force being applied to the terminal 32. Such a feature becomes more desirable as terminal size decreases.

As indicated above, the lock bar 120 has a wedge shaped portion 126. This wedge shaped portion 126 then digs into the angled surface 34 of the rib 30 when the pull-out force F exceeds a predetermined magnitude. This is another aspect of the improved terminal retention arrangement of the invention. An advantage of this feature is that the pull-out resistence increases substantially as the wedge shaped portion 126 of the lock bar 120 digs deeper and deeper into the lock nib 30.

The predetermined magnitude at which the wedge shaped portion 126 digs into the lock nib 30 varies and depends upon the physical characteristics of the electrical connector parts and their respective shapes, including for example, the hardness of the lock nib 30, the hardness of the lock bar 120 and the sharpness of the edge of the wedge shaped portion 126. This edge is preferably formed at the bottom or outer edge of the angled surface face of the wedge shaped portion 126 which defines an acute angle 150 with respect to the bottom surface of the lock bar 120.

Wedge portion 126 is preferably used in conjunction with an angled surface 34 of the lock nib 30. In such a case acute angle 150 is less than acute angle 36 to provide an edge to dig into angled surface 34.

As the terminal pull-out force F further increases, the wedge shaped portion 126 digs further and further into the angled surface 34 of the lock nib 30 until the penetration is enough so that angled surfaces 128 of the side walls 130, 131 engage the angled surface 34 of lock nib 30. The angled surfaces 128 of the side walls 130, 131 preferably define an acute angle 152 that is preferably substantially equal to the acute angle 36 defined by the angled surface 34 of nib 30 so that the contact area between the angled surfaces 128 of side walls 130, 131 and the angled surface 34 is maximized thereby maximizing further terminal pull-out resistance after the wedge shaped portion 126 digs into the angled surface 34. This is another aspect of the terminal retention arrangement of the invention.

As indicated above, three improved terminal retention features are possible in the invention; any one of which results in terminal retention improvement. However, it is preferable to use at least two improved terminal retention features and more preferable to use all three improved terminal retention features of the invention.

The exemplary embodiments shown and described above is provided merely by way of example and is not intended to limit the scope of the invention in any way. Exemplary ratios, materials and construction techniques are illustrative only and are not necessarily required to practice the invention. It is intended that the scope of the present invention herein disclosed should not be limited by the particular disclosed embodiment shown and described above, but should be defined only by a fair reading of the claims that follow.

Further modifications and alterations may occur to others upon reading and understanding the specification. It is intended to include all such modifications and alterations insofar as they come within the scope of the invention.

We claim:

1. An electrical connector having a terminal disposed in a terminal receiving cavity of a connector body, the terminal having a rigid lock bar engaging a rigid lock nib that projects from a wall of the connector body inwardly into the terminal receiving cavity to retain the terminal in the terminal receiving cavity, wherein:

the lock bar of the terminal has a wedge portion that digs into the lock nib of the terminal body responsive to a terminal pull-out force applied to the terminal when the terminal pull-out force exceeds a predetermined magnitude, the lock nib of the connector body has an angled surface that is engaged by the lock bar, the angled surface of the of the lock nib defines an acute angle with respect to the wall of the connector body, and the wedge portion of the lock bar defines an angle with respect to a bottom surface of the terminal that is less than the acute angle defined by the angled surface of the lock nib, the lock bar is attached to laterally spaced side walls of the terminals that have angled surfaces that are engageable with the angled surface of the lock nib, the angled surfaces of the side walls defining acute angles with respect to the bottom surface of the terminal that are substantially equal to the acute angle defined by the angled surface of the lock nib.

2. The electrical connector as defined in claim 1 wherein the lock nib of the connector body pushes the terminal outwardly toward the wall responsive to the terminal pull-out force applied to the terminal.

3. An electrical connector having a terminal disposed in a terminal receiving cavity of a connector body, the terminal having a rigid lock bar engaging a rigid lock nib that projects inwardly from a wall of the connector body into the terminal receiving cavity to retain the terminal in the terminal receiving cavity, wherein:

the lock bar of the terminal has a wedge portion that digs into the rigid lock nib of the terminal body responsive to a terminal pull-out force applied to the terminal that exceeds a predetermined magnitude, the lock nib of the connector body has an angled surface that is engaged by the lock bar and that pushes the terminal outward toward the wall of the connector body responsive to the terminal pull-out force applied to the terminal, the angled surface of the lock nib defines an acute angle with respect to the wall of the connector body, and the wedge portion of the lock bar defines an acute angle with respect to a bottom surface of the terminal that is less than the acute angle defined by the angled surface of the lock nib, the lock bar of the terminal is attached to laterally spaced side walls of the terminal that have angled surfaces that are engageable with the angled surface of the lock nib after the wedge portion of the lock bar digs into the angled surface of the lock nib, and the angled surfaces of the side walls define acute angles with respect to the bottom wall of the terminal that are substantially equal to the acute angle defined by the angled surface of the lock nib.

4. An electrical connector having a terminal disposed in a terminal receiving cavity of a connector body, the terminal having a rigid lock bar engaging a rigid lock nib that extends inwardly from a wall of the connector body into the terminal receiving cavity to retain the terminal in the terminal receiving cavity, wherein:

the rigid lock nib of the connector body has an angled surface that is engaged by the lock bar of the terminal and that pushes the terminal outward toward the wall responsive to a terminal pull-out force applied to the terminal, the lock bar is attached to laterally spaced side walls of the terminal that have angled surfaces that are engageable with the angled surface of the lock nib, the angled surface of the lock nib defines an acute angle with respect to the wall of the terminal receiving cavity, and the angled surfaces of the side walls define acute angles with respect to a bottom surface of the lock bar that are substantially equal to the acute angle defined by the angled surface of the lock nib, a wedge portion of the lock bar defines an angle with respect to the bottom surface of the lock bar that is less than the acute angle defined by the angled surface of the lock nib.

5. The electrical connector as defined in claim 4 wherein the wedge portion digs into the lock nib of the terminal body when the terminal pull-out force exceeds a predetermined magnitude.

* * * * *